United States Patent [19]

Biasotti et al.

[11] 4,204,841

[45] May 27, 1980

[54] DETERGENT GASOLINE COMPOSITION

[75] Inventors: Joseph B. Biasotti; Peter Dorn, both of Lagrangeville; Sheldon Herbstman, Spring Valley; Kenneth L. Dille, Wappingers Falls, all of N.Y.

[73] Assignee: Texaco Inc., White Plains, N.Y.

[21] Appl. No.: 31,556

[22] Filed: Apr. 19, 1979

[51] Int. Cl.[2] ..... C10L 1/22

[52] U.S. Cl. ..... 44/71; 44/72; 252/392

[58] Field of Search ..... 44/71, 72; 252/392

[56] References Cited

U.S. PATENT DOCUMENTS

| | | | |
|---|---|---|---|
| 3,773,479 | 11/1973 | Dorn et al. | 44/71 |
| 4,047,900 | 9/1977 | Dorn et al. | 44/71 |
| 4,144,034 | 3/1979 | Cummings | 44/71 |
| 4,144,036 | 3/1979 | Cummings | 44/71 |

*Primary Examiner*—Winston A. Douglas
*Assistant Examiner*—J. V. Howard
*Attorney, Agent, or Firm*—Carl G. Ries; Robert A. Kulason; James J. O'Loughlin

[57] ABSTRACT

A detergent motor fuel composition is provided comprising a primary aliphatic hydrocarbon amino alkylene-substituted asparagine represented by the formula:

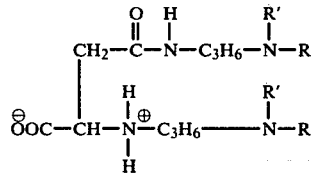

in which R is a primary aliphatic hydrocarbon radical and R′ is hydrogen or a methyl radical, and an N-primary alkyl-alkylene diamine represented by the formula:

$$R,R'—N—C_3H_6—NH_2$$

in which R is a primary aliphatic hydrocarbon radical and R′ is hydrogen or a methyl radical.

7 Claims, No Drawings

DETERGENT GASOLINE COMPOSITION

BACKGROUND OF THE INVENTION

1. Field of the Invention

Gasoline compositions are highly refined products. Despite this, they contain minor amounts of impurities which can promote corrosion during the period that the fuel is transported in bulk or held in storage. Corrosion can also occur in the fuel tank, fuel lines and carburetor of a motor vehicle. As a result, a commercial motor fuel composition must contain a corrosion inhibitor to inhibit or prevent corrosion.

Internal combustion engine design is undergoing changes to meet new standards for engine exhaust gas emissions. One design change involves the feeding of blow-by gases from the crankcase zone of the engine into the intake air supply to the carburetor rather than venting these gases to the atmosphere as in the past. Another change involves recycling part of the exhaust gases to the combustion zone of the engine in order to minimize objectionable emissions. Both the blow-by gases from the crankcase zone and the recycled exhaust gases contain significant amounts of deposit-forming substances which promote the formation of deposits in and around the throttle plate area of the carburetor. These deposits restrict the flow of air through the carburetor at idle and at low speeds so that an overrich fuel mixture results. This condition produces rough engine idling or stalling causing an increase in the amount of polluting exhaust gas emissions, which the engine design changes were intended to overcome, and decreasing fuel efficiency.

Certain N-alkyl-alkylene diamine compounds, as represented by N-oleyl-1,3-diaminopropane, are known to give carburetor detergency properties to gasoline. These additives, however, do not impart corrosion inhibiting properties to gasoline. As a result, a motor fuel containing an N-alkyl-alkylene diamine must be modified or formulated with an additional additive in order to have the necessary corrosion inhibiting properties for marketability.

2. DESCRIPTION OF THE PRIOR ART

U.S. Pat. No. 3,773,479 discloses a motor fuel composition containing an alkyl-substituted asparagine having a formula:

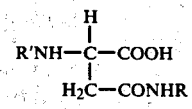

in which R and R' each represent secondary or tertiary alkyl radicals having from 7 to 20 carbon atoms. The corresponding compounds in which R and R' are straight chain radicals are too insoluble in gasoline to be effective as an additive.

A copending application disclosing a motor fuel composition containing the reaction product of an aliphatic ether monoamine and maleic anhydride was filed on Mar. 27, 1978 under Ser. No. 890,104.

A copending application disclosing an aliphatic hydrocarbon amino alkylene-substituted asparagine and a motor fuel composition containing same was filed on Apr. 19, 1979, 031557. This copending application is incorporated herein by reference.

SUMMARY OF THE INVENTION

A novel detergent motor fuel composition comprising a mixture of hydrocarbons in the gasoline boiling range containing a primary aliphatic hydrocarbon aminoalkylene-substituted asparagine, which is produced by reacting about two moles of an N-primary alkyl-alkylene diamine with a mole of maleic anhydride to produce a compound characterized by having a plurality of amino groups in an essentially straight chain primary alkyl hydrocarbon radical, in combination with an N-primary alkyl-alkylene diamine possesses good corrosion inhibiting properties and exhibits outstanding carburetor detergency properties.

The fuel composition of the invention prevents or reduces corrosion problems during the transportation, storage and the final use of the product. The gasoline of the invention also is especially effective in its carburetor detergency properties, particularly in its ability to prevent deposit build-up on a clean carburetor.

DESCRIPTION OF THE PREFERRED EMBODIMENTS

The primary aliphatic hydrocarbon amino alkylene-substituted asparagine additive component of the motor fuel composition of the invention is represented by the formula:

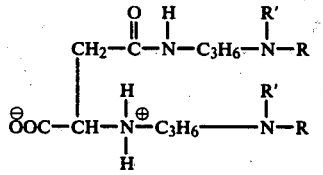

in which R represents a primary aliphatic hydrocarbon radical having from 6 to 30 carbon atoms and R' is hydrogen or a methyl radical. A preferred species of this additive component is one in which R is a straight chain primary aliphatic hydrocarbon radical and R' is hydrogen. A particularly preferred compound is one formed from a straight chain aliphatic hydrocarbon radical having from 16 to 20 carbon atoms and 1,3-propane diamine.

The preferred member of this detergent component is represented by the formula:

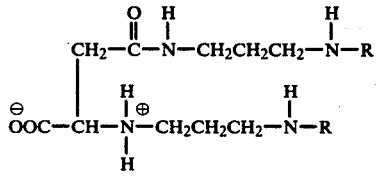

in which R is a primary aliphatic hydrocarbon radical having from 16 to 20 carbon atoms.

Examples of specific primary aliphatic hydrocarbon amino alkylene-substituted asparagine additives for the fuel composition of this invention include the following:

N,N'-di-(3-n-oleylamino-1-propyl) asparagine
N,N'-di-(3-n-dodecylamino-1-propyl) asparagine
N,N'-di-(3-octylamino-1-propyl) asparagine
N,N'-di-(3-stearylamino-1-propyl) asparagine N,N'-di-(3-decylamino-1-propyl) asparagine N,N'-di-(3-laurylamino-1-propyl) asparagine N,N'-di-(3-behenylamino-1-propyl) asparagine The second additive component of the motor fuel composition of this invention is an N-primary alkyl-alkylene diamine which is represented by the formula:

$$R, R'—N—C_3H_6—NH_2$$

in which R is a primary aliphatic hydrocarbon radical having from about 6 to 30 carbon atoms and R' is hydrogen or a methyl radical. Preferred N-primary alkyl-alkylene diamines are those in which R is a straight chain primary alkyl radical and R' is hydrogen. As employed herein the term N-alkyl-alkylene diamine covers both N-monoalkyl-alkylene diamine and the N-dialkyl-alkylene diamine structure when R' is a methyl radical.

The most preferred N-alkyl-alkylene diamine additive is represented by the formula:

$$R—NH—CH_2CH_2CH_2—NH_2$$

in which R is a straight chain primary alkyl aliphatic hydrocarbon radical havin from 16 to 20 carbon atoms.

Examples of suitable N-alkyl-alkylene diamine additives which can be beneficially employed in combination with the prescribed substituted asparagine include N-oleyl-1,3-propane diamine, N-lauryl-1,3-propane diamine, N-stearyl-1,3-propane diamine and N-dodecyl-1,3-propane diamine.

The additive composition of the invention is a mixture of the two additive components prescribed hereinabove. In general, the additive composition comprises from 30 to 70 weight percent based on the total weight of the additive composition of the primary aliphatic hydrocarbon amino-alkylene substituted asparagine, component A, and the balance of the prescribed N-alkyl-alkylene diamine compound, or component B. It is preferred to employ the additive components in approximately 50—50 weight percent amounts based on diluent free materials.

The following examples illustrate the novel additive composition of this invention.

EXAMPLE I

An additive is prepared by admixing N,N'-di-(3-n-oleylamino-1-propyl) asparagine with N-oleyl-1,3-propane diamine in 50—50 weight percent amounts based on diluent free materials.

EXAMPLE II

An additive is prepared by admixing N,N'-di-(3-lauryl amino-1-propyl) asparagine with N-oleyl-1,3-propane diamine in 50—50 weight percent amounts based on diluent free materials.

EXAMPLE III

An additive is prepared by admixing N,N'-di-(3-dodecylamino-1-propyl) asparagine with N-stearyl-1,3-propane diamine in 50—50 weight percent amounts based on diluent free materials.

EXAMPLE IV

An additive is prepared by admixing 70 weight percent of N,N'-di-(3-n-oleylamino-1-propyl) asparagine and 30 weight percent of N-oleyl-1,3-propane diamine based on the total additive composition of diluent free materials.

EXAMPLE V

An additive is prepared by admixing 30 weight percent of N,N'-di-(3-decylamino-1-propyl) asparagine and 70 weight percent of N-lauryl-1,3-propane diamine based on the total additive composition of diluent free materials.

The additive composition is employed in the motor fuel composition of the invention in a concentration ranging from about 0.001 to 0.003 weight percent based on the weight of the motor fuel composition. It is preferred to employ the additive in a concentration ranging from 0.0015 to 0.0025 weight percent with the most preferred concentration being about 0.002 weight percent, or a dosage equivalent to about 6 PTB or 6 pounds of additive per 1000 barrels of gasoline.

The base fuel in which the additive combination of the invention is employed is a mixture of hydrocarbons boiling in the gasoline boiling range. This base fuel may consist of straight-chain or branched-chain paraffins, cycloparaffins, olefins, and aromatic hydrocarbons, and any mixture of these. The base fuel can be derived from straight-run naphtha, polymer gasoline, natural gasoline or from catalytically reformed stocks and boils in the range from about 80° to 450° F. The composition and the octane level of the base fuel are not critical and any conventional motor fuel base can be employed in the practice of this invention.

The fuel composition of the invention may contain any of the additives normally employed in a motor fuel. For example, the base fuel may be blended with an anti-knock compound, such as a methyl-cyclopentadienyl manganese tricarbonyl or tetraalkyl lead compound, including tetraethyl lead, tetramethyl lead, tetrabutyl lead, and chemical and physical mixtures thereof, generally in a concentration from about 0.025 to 4.0 cc. per gallon of gasoline. The tetraethyl lead mixture commercially available for automotive use contains an ethylene chloride-ethylene bromide mixture as a scavenger for removing lead from the combustion chamber in the form of a volatile lead halide.

Gasoline blends were prepared from a typical base fuel mixed with specified amounts of the prescribed fuel additive of the invention. These fuels were then tested to determine the effectiveness of the additive in gasoline. The results obtained in this test using a commercial detergent gasoline are also given.

The base fuel employed for demonstrating the detergency effectiveness of the additive composition of the invention was an unleaded grade gasoline having a Research Octane Number of about 93. This gasoline consisted of about 32 percent aromatic hydrocarbons, 8 percent olefinic hydrocarbons and 60 percent paraffinic hydrocarbons and boiled in the range from 88° F. to 373° F.

The effect on carburetor detergency of the fuel composition of the invention was determined in the Buick Carburetor Detergency Test. This test is run on a Buick 350 CID V-8 engine equipped with a two barrel carburetor. The engine is mounted on a test stand and has operating EGR and PCV systems. The test cycle, shown in Table II, is representative of normal road operation. Approximately 300 gallons of fuel and three quarts of oil are required for each run.

Prior to each run the carburetor is completely reconditioned. Upon completion of the run the throttle plate deposits are visually rated according to a CRC Varnish rating scale (Throttle Plate Merit Rating) where 1 describes heavy deposits on the throttle plate and 10 a completely clean plate.

TABLE I

1973 BUICK CARBURETOR DETERGENCY TEST OPERATING CONDITIONS

| | Stage I | Stage II | Stage III |
|---|---|---|---|
| Duration, hours | 1 | 3 | 1 |
| Speed, r.p.m. | 650 ± 25 | 1500 ± 25 | 2000 ± 25 |
| Torque, ft.-lbs. | 0 | 80 ± 2 | 108 ± 2 |
| Water Out, °F. | 205 ± 5 | 205 ± 5 | 205 ± 5 |
| Carburetor Air, °F. | 140 ± 5 | 140 ± 5 | 140 ± 5 |
| Exhaust Back Pres. in Hg | — | 0.7 ± 0.1 | — |
| Man. Vac. In. Hg | — | 15.8 | 14.2 |
| Fuel Flow, lbs/hr | 0.7 | 7.5 | 12.0 |
| Test Duration, 120 hours | | | |

The results of this test are set forth in the following table:

TABLE II

BUICK CARBURETOR DETERGENCY TEST

| Run | Fuel Composition | Additive Concentration | Carburetor Rating (Average) |
|---|---|---|---|
| 1. | Base Fuel | None | 3.6 |
| 2. | Base Fuel | 6 PTB(1) Comp. A(2) | 7.7 |
| 3. | Base Fuel | 6 PTB Comp. B(3) | 8.5 |
| 4. | Base Fuel | 6 PTB Example I | 9.3 |
| 5. | Comparison Fuel A(4) | — | 6.2 |
| 6. | Comparison Fuel B(4) | — | 5.8 |

(1)PTB = pounds of additive per 1000 barrel of fuel
(2)Component A is N,N'-di-(3-n-oleylamino-1-propyl) asparagine
(3)Component B is N-oleyl-1,3-propane diamine
(4)Commercial unleaded detergent gasoline.

The foregoing results demonstrate that the novel fuel composition of the invention was surprisingly effective for achieving carburetor throttle plate cleanliness as measured by the CRC Varnish rating scale in the Buick Carburetor Detergency Test.

We claim:

1. A motor fuel composition comprising a mixture of hydrocarbons in the gasoline boiling range containing from about 0.001 to 0.003 weight percent of an additive composition comprising (A) a component represented by the formula:

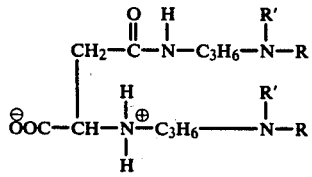

in which R is a primary aliphatic hydrocarbon radical having from about 6 to 30 carbon atoms and R' is a hydrogen or a methyl radical, and (B) an N-alkyl-alkylene diamine component represented by the formula:

$$R,R'—N—C_3H_6—NH_2$$

in which R is a primary aliphatic hydrocarbon radical having from about 6 to 30 carbon atoms and R' is hydrogen or a methyl radical, said additive composition consisting of from about 30 to 70 weight percent of said component A and the balance said component B based on diluent free materials.

2. A motor fuel composition comprising a mixture of hydrocarbons in the gasoline boiling range containing from about 0.001 to 0.003 weight percent of an additive composition comprising:

(A) a component represented by the formula:

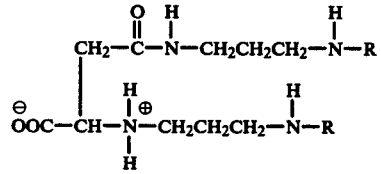

in which R is a straight chain primary aliphatic hydrocarbon radical having from 16 to 20 carbon atoms, and (B) an N-alkyl-alkylene diamine component represented by the formula:

$$R—NH—CH_2CH_2CH_2—NH_2$$

in which R is a straight chain primary alkyl aliphatic hydrocarbon radical having from 16 to 20 carbon atoms, said additive composition comprising from about 30 to 70 weight percent of said component A and the balance said component B based on diluent free materials.

3. A motor fuel composition according to claim 1 in which said component A is N,N'-di-(3-n-oleylamino-1-propyl) asparagine and said component B is N-oleyl-1,3-propane diamine.

4. A motor fuel composition according to claim 1 in which said component A is N,N'-di-(3-laurylamino-1-propyl) asparagine and said component B is N-oleyl-1,3-propane diamine.

5. A motor fuel composition according to claim 1 in which said component A is N,N'-di-(3-dodecylamino-1-propyl) asparagine and said component B is N-stearyl-1,3-propane diamine.

6. A motor fuel composition according to claim 1 containing about 0.0015 to 0.0025 weight percent of said additive composition.

7. A motor fuel composition according to claim 1 in which said additive composition consists of about 50 weight percent of component A and about 50 weight percent of component B based on diluent free materials.

* * * * *